United States Patent [19]

Folkins et al.

[11] Patent Number: 4,614,165

[45] Date of Patent: Sep. 30, 1986

[54] EXTENDED LIFE DEVELOPMENT SYSTEM

[75] Inventors: Jeffrey J. Folkins, Rochester; Cyril G. Edmunds; Steven C. Hart, both of Webster, all of N.Y.

[73] Assignee: Xerox Corporation, Stamford, Conn.

[21] Appl. No.: 801,366

[22] Filed: Nov. 25, 1985

[51] Int. Cl.[4] ..... G03G 13/09

[52] U.S. Cl. ..... 118/657; 430/120; 430/122; 118/689; 118/690

[58] Field of Search ..... 118/653, 655, 46, 689, 118/690, 657; 430/120

[56] References Cited

U.S. PATENT DOCUMENTS

| | | | |
|---|---|---|---|
| 3,923,503 | 12/1975 | Hagenbach | 430/109 X |
| 4,226,525 | 10/1980 | Sakamoto | 118/689 X |
| 4,236,485 | 12/1980 | Inukai | 118/690 |
| 4,511,639 | 4/1985 | Knott et al. | 430/108 |

FOREIGN PATENT DOCUMENTS

| | | |
|---|---|---|
| 56-159654 | 12/1981 | Japan . |
| 57-11357 | 1/1982 | Japan . |
| 57-172349 | 10/1982 | Japan . |

*Primary Examiner*—John D. Welsh

*Attorney, Agent, or Firm*—H. Fleischer; J. E. Beck; R. Zibelli

[57] ABSTRACT

An apparatus which develops an electrostatic latent image recorded on a photoconductive member employed in an electrophotographic printing machine having a finite, usable life. The apparatus employs a developer material which ages during the life of the electrophotographic printing machine. A continuous supply of carrier granules is furnished to the developer material. The addition of these carrier granules extends the useful life of the developer material so as to correspond to at least the useful life of the electrophotographic printing machine.

24 Claims, 7 Drawing Figures

EXTENDED LIFE DEVELOPMENT SYSTEM

This invention relates generally to an electrophotographic printing machine, and more particularly concerns an apparatus for developing an electrostatic latent image recorded on a photoconductive member wherein the developer material employed in the apparatus has a useful life at least equal to the usable life of the electrophotographic printing machine.

Generally, the process of electrophotographic printing includes charging a photoconductive member to a substantially uniform potential so as to sensitize the surface thereof. The charged portion of the photoconductive surface is exposed to a light image of an original document being reproduced. This records an electrostatic latent image on the photoconductive member corresponding to the informational areas contained in the original document. After the electrostatic latent image is recorded on the photoconductive member, the latent image is developed by bringing a developer material into contact therewith. This forms a powder image on the photoconductive member which is subsequently transferred to a copy sheet. Finally, the powder image is heated to permanently fuse it to the copy sheet in image configuration.

Generally, the developer material employed in an electrophotographic printing machine includes carrier granules having toner particles adhering triboelectrically thereto. This two component mixture is brought into contact with the photoconductive surface. The toner particles are attracted from the carrier granules to the latent image. It is clear that the developer material is an essential ingredient in the electrophotographic printing machine. As the useful life of the developer material approaches an end, the quality of the copy being reproduced in printing machines degradates. Machine service calls are severely impacted by the failure of the developer material not only from the perspective developer material replacement, but also from the increased frequency of service calls for copy quality reasons. These copy quality related calls may be caused by dirt generation from the developer material which is nearing the end of useful life. Therefore, the developer material is frequently changed without knowing the condition thereof to prevent the generation of dirt. Whereas, this can be wasteful of developer material, if useful developer material is discarded, it might be presently economically justifiable to save additional service calls. However, it is far more desirable not to be required to change the developer material at all during the useful life of the electrophotographic printing machine. Thus, it would be highly desirable to extend the usable life of the developer material to correspond at least to that of the electrophotographic printing machine. Various electrophotographic printing machines have periodically changed or modified the developer material employed therein. For example, Pitney Bowes copiers have used a high concentration of carrier in the toner supply, i.e. about 78% carrier by weight. The developer material in the development system appears to have been replaced about every 25,000 copies. Thus, in the Pitney Bowes machine, a flow of carrier and toner particles is being continuously furnished to the developer material. However, it appears that even with this continuous addition of developer material, the developer material in the Pitney Bowes machines did not have a useful life that corresponded to that of the printing machine. The Brunning 2000 series copiers replenished the developer material in the development system by flowing developer material therethrough on a continuous basis. The developer material replenishing the developer material in the development system had about 30% by weight of carrier granules and about 70% by weight of toner particles. This copier appeared to develop significant carrier bead problems on the copies and the developer material had to be periodically replenished. The Apeco copiers continuously furnished a supply of 96% carrier granules by weight and 4% toner particles by weight to the developer material in the development system. However, this system flushed large quantities of the replenishing developer material through the developer housing. resulting in utilization of excessive amounts of developer material within the copier. This required a remote container for housing a supply of this developer material which continuously flushed through the development system. The developer material being flushed through the development system was predominantly carrier granules with only a small percent by weight being toner particles.

Various other approaches have been devised for adding either toner particles or carrier granules to the developer material within the development system. The following disclosures appear to be relevant:

Japanese Application No. 55-62720, Applicant: Fuji Xerox, Inc., Application Date: May 14, 1980, Laid-Open No. 56-159654, Laid-Open Date: Dec. 9, 1981.

Japanese Application No. 55-85656, Applicant: Ricoh, Inc., Application Date: June 24, 1980, Laid-Open No. 57-11357, Laid-Open Date: Jan. 21, 1982.

Japanese Patent Application No. 56-56962, Applicant: Ricoh, Inc., Application Date: Apr. 17, 1981, Laid-Open No. 57-172349 Laid-Open Date: Oct. 23, 1982.

U.S. Patent No. 4,511,639, Patentee: Knott et al., Issued: Apr. 16, 1985.

U.S. Patent No. 3,923,503, Patentee: Hagenbach Issued: Dec. 2, 1975.

The relevant portions of the foregoing disclosure may be briefly summarized as follows:

The Fuji Xerox publication discloses a development system wherein the consumption of carrier granules is restricted to being equal to or less than 20% by weight of the developer material. A replenishing toner having carrier granules therein equal to or less than 20% by weight is furnished to the developer material. In this way, as the carrier granules are consumed, fresh carrier is added so that carrier in the developer material is always kept at a constant level.

Ricoh ('357) describes a sieve which passes toner particles therethrough but not carrier granules. The developer material is placed in a container with a sieve positioned over the opening. The toner particles pass through the sieve while the carrier granules are prevented from passing therethrough. These toner particles are added to the carrier granules. This permits the fatigued developer material to recover and good quality images obtained for a longer period of time.

Ricoh ('349) discloses a two-component developer material containing carrier granules and toner particles. Toner particles having a high charging capacity are employed as a replenishing material at the initial stages of the copying apparatus. Toner particles having a low charging capacity are employed as a replenishing agent at subsequent stages in the copying operations.

Knott et al describes an apparatus that regenerates the carrier particles of a developer material. A portion of the developer material is continuously or periodically removed from the main body of the developer material in the developer housing chamber and furnished to a regenerating device. The regenerating device impacts the flakes off the toner crust formations. The regenerated developer material is then recycled back to the main supply of developer material in the housing of the development system.

Hagenbach discloses a development system wherein small quantities of toner particles are furnished to the developer material to replenish the particles depleted during the development process.

In accordance with one aspect of the present invention, there is provided an apparatus for developing an electrostatic latent image employed in a printing machine having a finite useful life. Means are provided for transporting a developer material comprising at least carrier granules and toner particles into contact with the electrostatic latent image. A housing, defining a chamber having a supply of developer material therein, is in communication with the transporting means. The transporting means receives the developer material therefrom. Means discharge toner particles and carrier granules into the chamber of the housing with the carrier granules being added to the chamber of the housing so that the usable life of the developer material is at least equal to the usable life of the printing machine. The ratio of toner particles to carrier granules by weight being supplied to chamber of the housing is substantially greater than the ratio of toner particles to carrier granules by weight in the chamber of the housing.

Pursuant to another aspect of the present invention, there is provided an electrophotographic printing machine having a finite usuable life. An electrostatic latent image is recorded on the surface of the photoconductive member. Means transport developer material comprising at least carrier granules and toner particles into contact with the surface of the photoconductive member having the electrostatic latent image recorded thereon. A housing, defining a chamber having a supply of developer material therein, is in communication with the chamber of the housing for receiving the developer material thereat. Means discharge toner particles and carrier granules into the chamber of the housing with the carrier granules being added to the chamber of the housing so that the usable life of the developer material is at least equal to the usable life of the electrophotographic printing machine. The ratio of toner particles to carrier granules by weight being supplied to the chamber of the housing is substantially greater than the ratio of toner particles to carrier granules by weight in the chamber of the housing.

Still another aspect of the present invention is a method of developing electrostatic latent image recorded on a photoconductive member employed in an electrophotographic printing machine having a finite usable life. The method of developing includes the steps of transporting a developer material comprising at least carrier granules and toner particles from a chamber of a housing storing a supply thereof to the surface of the photoconductive member having the electrostatic latent image recorded thereon. Toner particles and carrier granules are discharged into the chamber of the housing with the carrier granules being added to the chamber of the housing so that the usable life of the developer material is at least equal to the usable of the electrophotographic printing machine. The ratio of toner particles to carrier granules by weight being supplied to the chamber of the housing is substantially greater than the ratio of toner particles to carrier granules by weight in the chamber of the housing.

Other features of the present invention will become apparent as the following description proceeds and upon reference to the drawings in which.

While the present invention will hereinafter be described in connection with various embodiments thereof, it will be understood that it is not intended to limit the invention to these embodiments. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 1 printing machine will be shown hereinafter schematically and their operation described briefly with reference thereto.

Figure 1:
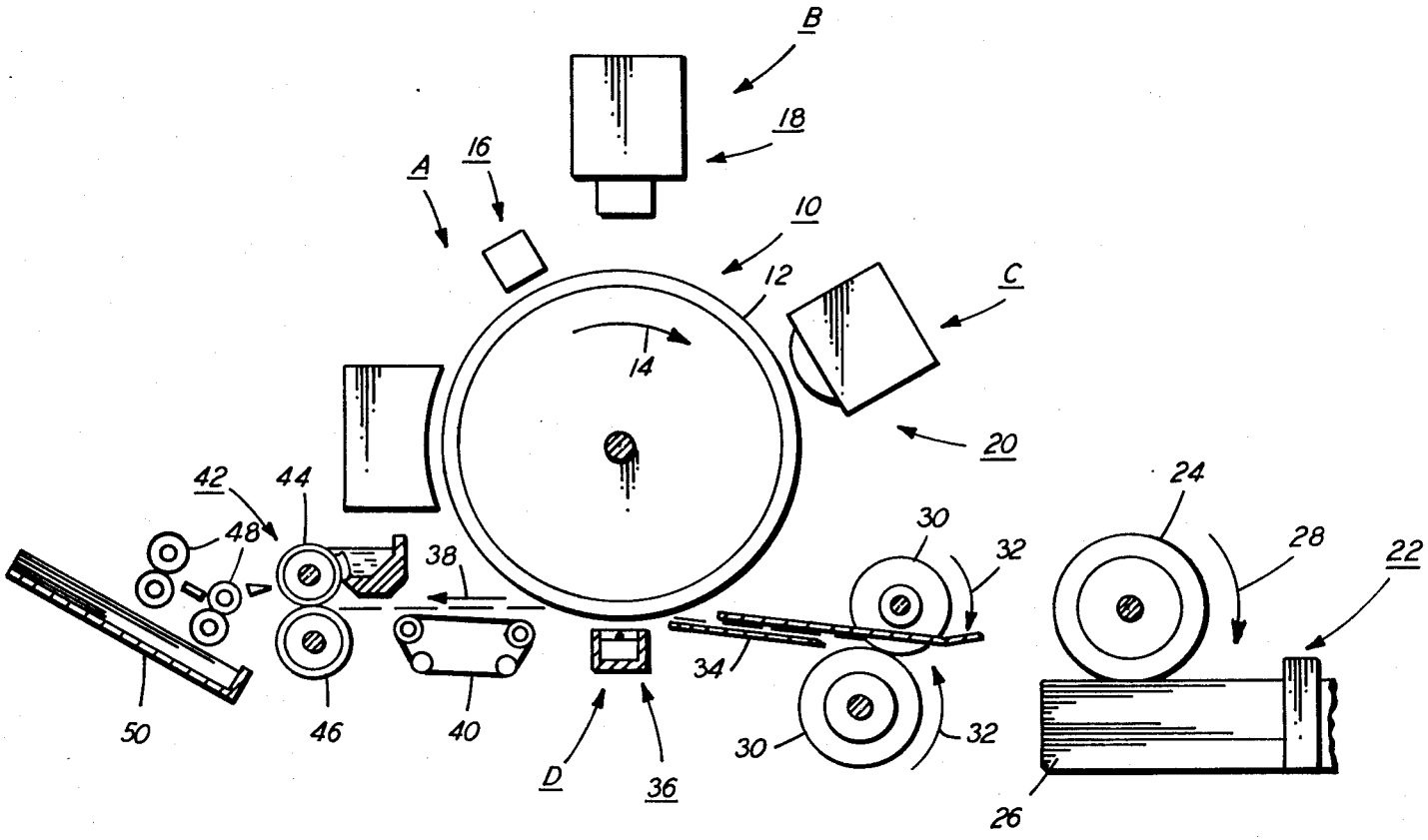
FIG. 1 is a schematic elevational view of an illustrative electrophotographic printing machine incorporating the features of the present invention therein.

As shown in FIG. 1, the illustrative electrophotographic printing machine employs a drum 10 having a photoconductive surface 12. Preferably, photoconductive surface 12 comprises a selenium alloy adhering to a conductive substrate, e.g. an electrically grounded aluminum alloy. Drum 10 moves in the direction of arrow 14 to advance photoconductive surface 12 sequentially through the various processing stations disposed about the path of movement thereof.

Initially, a portion of photoconductive surface 12 passes through charging station A. At charging station A, a corona generating device, indicated generally by the reference numeral 16, charges photoconductive surface 12 to a relatively high, substantialy uniform potential.

Next, the charged portion of photoconductive surface 12 is advanced through exposure station B. Exposure station B includes an exposure system, indicated generally by the reference numeral 18. Exposure system 18 includes a light source which illuminates an original document positioned face down upon a transparent platen. Light rays reflected from the original document are transmitted through a lens to form a light image thereof. The light image is focused onto the charged portion of photoconductive surface 12 to selectively dissipate the charge thereon. This records an electrostatic latent image on photoconductive surface 12 which corresponds to the informational areas contained within the original document. One skilled in the art will appreciate that in lieu of the foregoing optical system, a modulated beam of energy, i.e. a laser beam, or other suitable device, such as light emitting diodes, may be used to irradiate the charged portion of the photoconductive surface so as to record selected information thereon. Information from a computer may be employed to modulate the laser beam.

After the electrostatic latent image is recorded on photoconductive surface 12, drum 10 advances the latent image to development station C. At development station C, a magnetic brush development system, indicated generally by reference numeral 20, advances a developer material comprising at least carrier granules and toner particles into contact with the electrostatic latent image. The latent image attracts the toner particles from the carrier granules of the developer material to form a toner powder image on photoconductive surface 12 or drum 10. In the development system, toner particles and a small amount of carrier granules are continually added to the developer material so that the life the developer material is at least equal to the useful life of the electrophotographic printing machine. The detailed structure of development system 20 will be described hereinafter with reference to FIGS. 2 through 7, inclusive.

Drum 10 then advances the toner powder image adhering to photoconductive surface 12 to transfer station D. At transfer station D, a sheet of support material is moved into contact with the powder image. The sheet of support material is advanced to transfer station D by a sheet feeding apparatus, indicated generally by the reference numeral 22. Preferably, sheet feeding apparatus 22 includes a feed roll 24 contacting the uppermost sheet of a stack of sheets 26. Feed roll 24 rotates in the direction of arrow 28 to advance the uppermost sheet into the nip defined by forwarding rollers 30. Forwarding rollers 30 rotate in the direction of arrow 32 to advance the sheet into chute 34. Chute 34 directs the advancing sheet of support material into contact with photoconductive surface 12 of drum 10 in a timed sequence so that the toner powder developed thereon contacts the advancing sheet at transfer station D.

Preferably, transfer station D includes a corona generating device 36 for spraying ions onto the backside of the sheet. This attracts the toner powder image from photoconductive surface 12 to the sheet. After transfer, the sheet continues to move in the direction of arrow 38 onto conveyor 40 which advances the sheet to fusing station E.

Fusing station E includes a fuser assembly, indicated generally by the reference numeral 42, which permanently fuses the transferred toner powder image to the sheet. Preferably, fuser assembly 42 includes a heated fuser roller 44 and a back-up roller 46. The sheet passes between fuser roller 44 and a back-up roller 46. The sheet passes between fuser roller 44 and back-up roller 46 with the toner powder image contacting fuser roller 44. In this manner, the toner powder image is permanently fused to the sheet. After fusing, forwarding rollers 48 advance the sheet to catch tray 50 for removal from the printing machine by the operator.

Invariably, after the sheet of support material is separated from photoconductive surface 12 of drum 10, some residual particles remain adhering thereto. These residual particles are removed from photoconductive surface 12 at cleaning station F. Preferably, cleaning station F includes a rotatably mounted brush in contact with photoconductive surface 12. The particles are cleaned from photoconductive surface 12 by the rotation of the brush in contact therewith. Subsequent to cleaning, a discharge lamp floods photoconductive surface 12 with light to dissipate any residual electrostatic charge remaining thereon prior to the charging thereof for the next successive imaging cycle.

Figure 2:
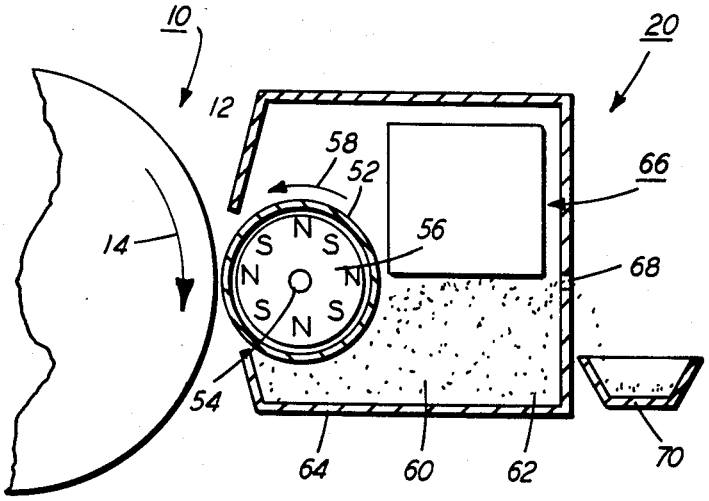
FIG. 2 is a elevational view, partially in section, showing the development apparatus used in the FIG. 1 printing machine.

It is believed that the foregoing description is sufficient for purposes of the present application to illustrate the general operation of an electrophotographic printing machine incorporating the features of the present invention therein. Referring now to FIG. 2, there is shown development apparatus 20 in greater detail. Development apparatus 20 includes a tubular roll 52 mounted rotatably on a shaft 54. An elongated magnetic cylinder 56 is disposed interiorly of tubular roll 52 and spaced from the interior circumferential surface thereof. Magnet 56 has a plurality of magnetic poles impressed thereon. Preferably, tubular roll 52 is made from aluminum with magnet 56 being made from barium ferrate. Magnet 56 is mounted stationarily. As tubular roll 52 rotates in the direction of arrow 58, the developer material is transported closely adjacent to photoconductive surface 12 of drum 10. In the development zone, the electrostatic latent image attracts the toner particles from the carrier granules. A voltage source electrically biases tubular roll 52 to a suitable polarity and magnitude so that the toner particles are deposited on the latent image. As is shown in FIG. 2, a supply of developer material 60 is stored in chamber 62 of housing 64. Tubular roll 52 is mounted, at least partially, in chamber 62 of housing 64 with the portion thereof extending outwardly through an opening in housing 64 so that the developer material is readily advanced, during the rotation of tubular roll 52 in direction of arrow 58, to the latent image recorded on the photoconductive surface 12 of drum 10. As the electrophotographic printing machine is used, toner particles are depleted therefrom and must be replenished. In addition, it has been found that the carrier granules age and the entire developer material, i.e., both carrier granules and toner particles be periodically replaced in order to obtain the requisite copy quality. In order to solve this problem and be capable of employing a developer material having a useful life at least equal to the usable life of the electrophotographic printing machine, carrier granules are trickled into the developer material 60. A discharging unit 66 dispenses a small quantity of carrier granules and the requisite amount of toner particles to developer material 60. Discharging unit 66 may be located interiorly of chamber 62 of housing 64, or may be located remotely therefrom. The detailed structure of discharging unit 66 will be described hereinafter with reference to FIGS. 5 through 7, inclusive. With continued reference to FIG. 2, an exit port 68 is located in the side wall of housing 64. As the quantity of developer material 60 in chamber 62 exceeds a predetermined amount, i.e. as dictated by the location of exit port 68 in the side wall of housing 64, the extraneous developer material exits chamber 62 via exit port 68 and is discharged to waste container 70. Waste container 70 may be periodically emptied by the machine operator. One skilled in the art will appreciate that in lieu of an exit port, a stand pipe may be employed. The height of the stand pipe determines the amount of developer material in the developer housing chamber with the extraneous developer material being discharged from the bottom opening of the stand pipe to the waste container. Discharging unit 66 discharges toner particles and carrier granules into chamber 62 of housing 64. The rate that the carrier granules are furnished to chamber 62 of housing 64 is selected so that the usable life of the developed material 60 is at least equal to the usable life of the electrophotographic printing machine. The ratio of toner particles to carrier granules by weight being supplied to chamber 62 is substantially greater than the ratio of toner particles to carrier granules by weight of developer material 60 in chamber 62 of housing 64. The rate at which discharging unit 66 adds carrier granules to chamber 62 of housing 64 is a function of the rate of aging of the carrier material in the chamber 62 of housing 64 and the required property of the developer material of 60 which changes with aging, e.g. the charging ability of developer material 60 in the chamber 62 of housing 64, to ensure that the usable life of the developer material 60 in chamber 62 of housing 64 is at least equal to the life of the electrophotographic printing machine.

There are several properties of developer materials which change with age, e.g. charging ability, conductivity, impurities, etc. The theory for holding only the charging ability, $A_t$, property constant will be described hereinafter. It is believed that all of the developer material properties will be affected and maintained in the same manner as that described with respect to the charging ability thereof. The charging ability of the developer material in the chamber 62 of housing 64 may be expressed by the following equation:

$$A_t = A_{initial} + [A_{dispensing}/(1+a/d)) - A_{initial}][1 - e^{-(a+d)(No.\ Copies)}]$$

The terms of the foregoing equation may be defined as follows:

$A_{initial}$ = Initial charging ability of developer material in the chamber of the housing.

$A_{dispensing}$ = Nominal charging ability of the carrier granules being discharged by discharging unit 66 into the chamber of the housing.

d = Dispensing rate of the carrier granules, i.e. the fraction of the total carrier granules in the developer housing replaced per copy.

a = Natural aging rate of the developer material, i.e. the fraction of developer material naturally aged per copy. The natural aging rate, a, is determined empirically. The steady state value for the charging ability may be expressed as:

$$A_{t(steady\ state)} = A_{dispensing}/[1+a/d]$$

This latter equation describes saturation/steady state results of dispensing carrier granules into the developer material in the chamber of the housing. For the carrier granule dispensing system to operate satisfactorily, this relationship must give a larger charging ability value than the minimum charging ability value of the developer material within the operating window boundary. It appears that the important parameter needed to determine whether this situation is achieved is the ratio of the natural aging rate to the rate of replacement of carrier granules. For any material with a given aging parameter, the dispense rate of the carrier granules must be adjusted to achieve a low enough ratio of aging to dispensing rate of the carrier granules.

The foregoing theory is correct if the natural aging of the carrier granules being supplied follows the following relationship:

$$A_t = A_{dispensing} e^{(-a)(No.\ Copies)}$$

This relationship is generally followed. A developer dispensing formula can be derived for each natural aging relationship.

Figure 3:
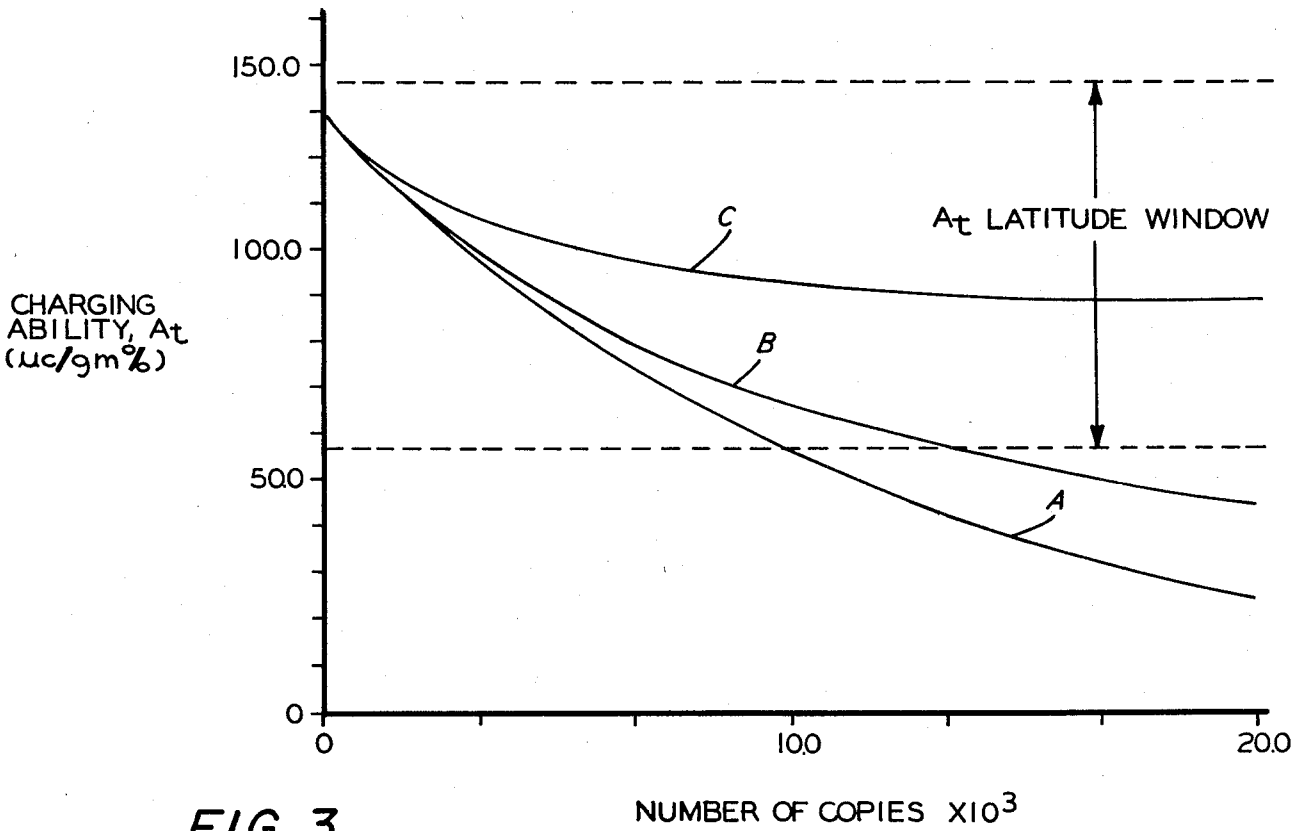
FIG. 3 is a curve showing the effect of replenishing the developer material in the FIG. 2 development apparatus.

FIG. 3 illustrates a typical graph of the developer material charging ability as a function of the age of the developer material. The parameter $A_t$, i.e. the developer material charging ability, may also be considered the triboelectric charging ability of the developer material for any specified concentration of toner particles therein. Curve A shows the natural aging properties of the charging ability of a typical developer material. For proper development of the electrostatic latent image, there is an operating latitude window for the charging ability of the developer material. Typically, a developer material is chosen which has an initial charging ability roughly near the maximum allowable charging ability of the latitude window. As the developer material naturally ages, the charging ability thereof gradually decreases and falls beneath the latitude window lower boundary. At this time, the entire developer material within the chamber of the housing must be replaced with a new developer material. Thus, there is a life cycle and replacement schedule with conventional systems. However, when small amounts of carrier granules are added continuously, the charging ability parameter of the developer material will not be reduced as quickly and the natural aging of the developer material and the time before failure, and, hence, the replacement time will be significantly extended. If carrier granules are added to the developer material at some rate which is not optimum, the life of the developer material will be extended and the foregoing is shown by curve B. However, if a naturally long life developer material is employed and the proper dispensing rate of carrier granules selected, the charging ability of the developer material will remain within the latitude window for at least the life of the electrophotographic printing machine and there will no longer be a need to change the developer material at some periodic schedule. The foregoing is shown by curve C.

Figure 4:
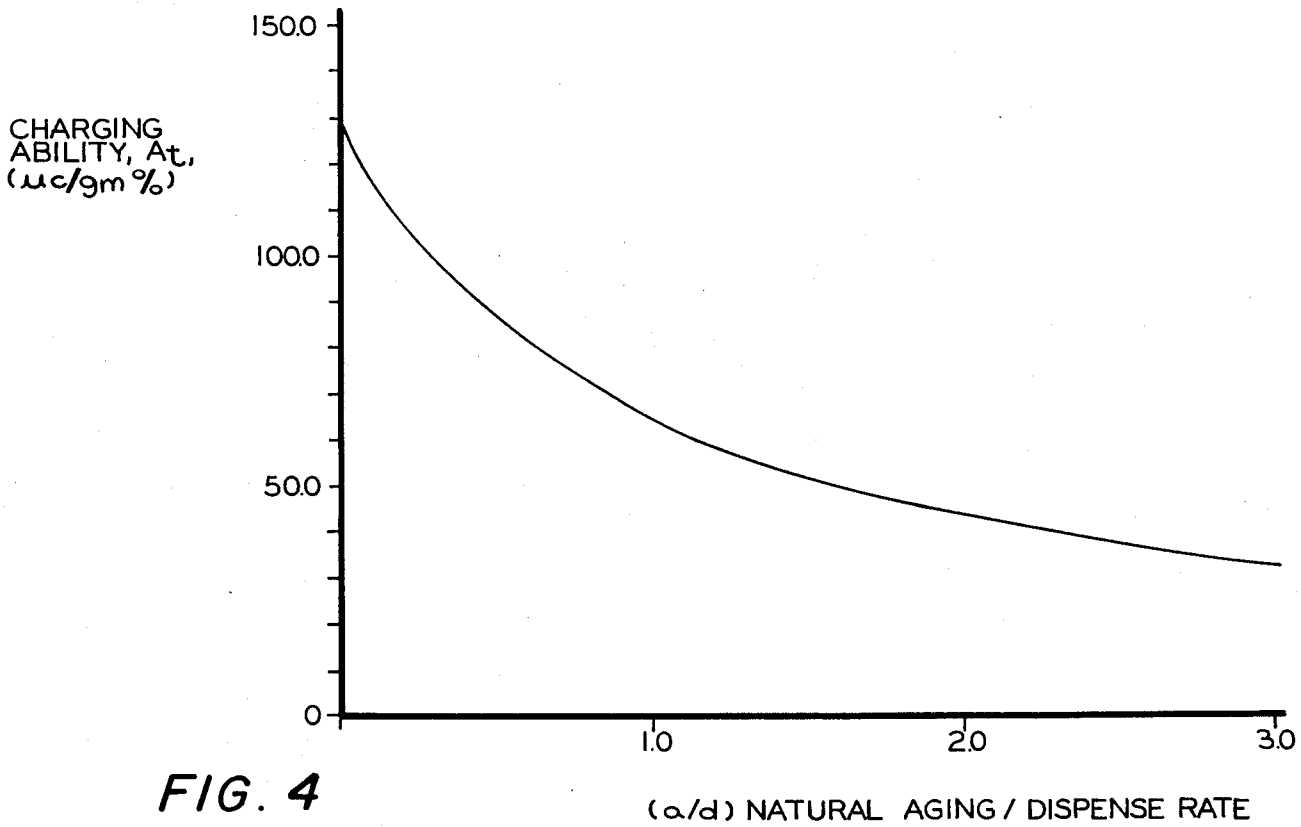
FIG. 4 is a curve which may be employed in conjunction with the FIG. 3 curve for determining the proper dispense rate.

Turning now to FIG. 4, there is shown an illustrative curve of the relationship between asymptotic developer material charging ability of the curve of FIG. 3 and the ratio of the natural aging rate to the carrier particle dispense rate. For example, if it is desired to maintain the charging ability of the developer material above the minimum level, as defined by the operating latitude window (FIG. 3), then the ratio of the natural aging to carrier dispense rate may be determined from the curve of FIG. 4. Inasmuch as the natural aging of the developer material has been previously determined empirically, then the required dispensing rates of the carrier granules is explicitly defined. It should be noted that the steady state value for the charging ability of the developer material is dependent only upon the ratio of the natural aging of the developer material and the dispense rate of the carrier granules. Hence, in the steady state, the charging ability of the developer material is independent of the size of the chamber of the housing storing the developer material. This means that a system of this type will operate in exactly the same fashion with any size chamber. This enables the use of very small chambers optimizing space considerations within the printing machine.

In addition to dispensing carrier granules having the same chemical properties as that of the carrier granules within the developer material 60 in chamber 62 of housing 64, carrier granules having a different chemical composition may also be dispensed. Thus, the carrier granules that are being dispensed from discharging unit 66 will have a different chemical composition than those of developer material 60 in chamber 62 of housing 64. As shown in FIG. 3, with carrier granule dispensing, as illustrated by curve C, the charging ability of the developer material is initially at a higher value than resultant steady state level. This introduces a variation in copy quality within the electrophotographic printing machine. Ideally, it desirable to have the initial value of the charging ability substantially equal to that of the steady state value. This will not only improve copy quality, but will also reduce the process control requirements within the printing machine. This may be achieved by choosing carrier granules having the steady state charging ability of the developer material as the initial charge in chamber 62 of housing 64. The carrier granules being added to chamber 62 of housing 64 will be of a different chemical composition and have a higher initial charging ability, i.e. the initial charging ability of curve C of FIG. 3. The charging ability of the carrier granules in chamber 62 of housing 64 and the charging ability of carrier granules being added thereto should be in the ratio of their respective $(1+a/d)$. In addition to employing two sets of carrier granules having different chemical compositions, carrier granules having the same chemical composition may be employed but the pre-age or pre-blend of the carrier granules being added requires a charging ability which naturally drops to the desired steady state value of the charging ability of the blended carrier granules in chamber 62 of housing 64.

Figure 5:
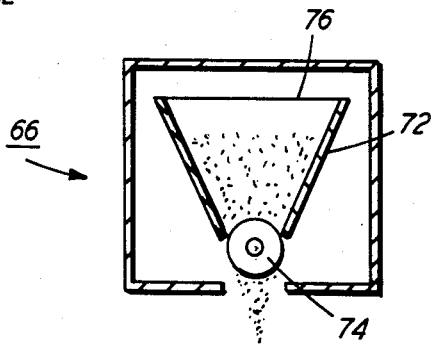
FIG. 5 is an elevational view, partially in section, showing one embodiment of the apparatus used to furnish carrier granules and toner particles to the developer material in the chamber of the FIG. 2 development apparatus.
Figure 6:
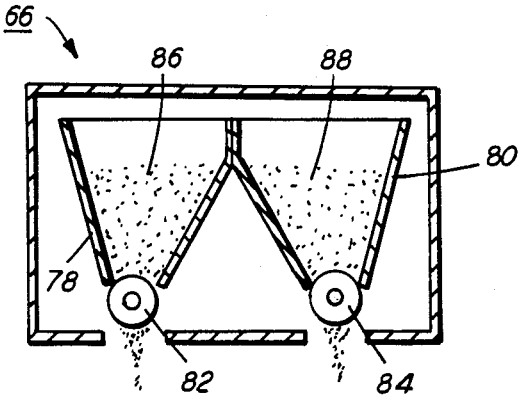
FIG. 6 is another embodiment of the apparatus used to furnish carrier granules and toner particles to the developer material in the chamber of the housing shown in the FIG. 2 development apparatus.
Figure 7:
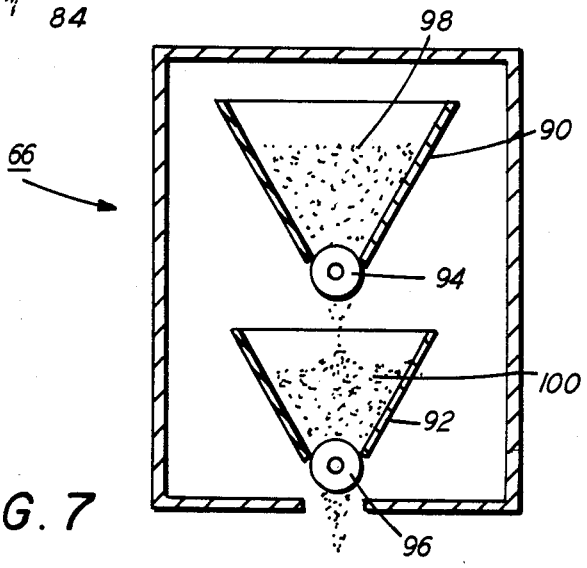
FIG. 7 is still another embodiment of the apparatus used to furnish carrier granules and toner particles to the chamber of the housing of the FIG. 2 development apparatus.

Referring now to FIGS. 5 through 7, inclusive, these figures all depict various embodiments of discharging unit 66. As shown in FIG. 5, discharging unit 66 includes an open ended hopper 72 having a foam roller 74 positioned in the open end thereof. A mixture of carrier granules and toner particles 76 is stored in hopper 72. As roller 74 rotates, carrier granules and toner particles are discharged from hopper 72 to developer material 60 in chamber 62 of housing 74. The ratio of toner particles to carrier granules by weight being discharged from hopper 72 is substantially greater than the ratio of toner particles to carrier granules by weight in developer material 60 in chamber 62 of housing 64. By way of example, the developer material being dispensed from discharging unit 66 may be 25% carrier granules by weight and 75% toner particles by weight with developer material 60 in chamber 62 of housing 64 being about 96% carrier granules by weight and 4% toner particles by weight.

Turning now to FIG. 6, there is shown another embodiment of discharging unit 66. As depicted thereat, discharging unit 66, includes open ended hoppers 78 and 80. A foam roller 82 is disposed in the open end of hopper 78 and mounted rotatably thereat. A foam roller 84 is mounted rotatably in the open end of hopper 80. Hopper 78 includes a supply of replenishment carrier granules therein. Hopper 80 includes a supply of replenishment toner particles therein. As foam roller 82 rotates, carrier granules are discharged from discharging unit 66 into developer material 60 in chamber 62 of housing 64. Similarly, as foam roller 84 rotates, toner particles 88 are dispensed from discharging unit 66 to developer material 60 in chamber 62 of housing 64. Once again, the ratio of toner particles 88 to carrier 86 by weight being dispensed from discharging unit 66 is substantially greater than the ratio of toner particles to carrier granules by weight of developer material 60 in chamber 62 of housing 64.

Still another embodiment of discharging unit 66 is shown in FIG. 7. As shown thereat, open ended hoppers 90 and 92 have foam rollers 94 and 96 mounted rotatably in the open ends thereof, respectively. Hopper 90 stores a supply of replenishment carrier granules therein. Hopper 92 stores a supply of replenishment toner particles, initially, therein. As foam roller 94 rotates, carrier granules 98 are added to toner particles 100 in hopper 92. As foam roller 96 rotates, this combination of carrier granules 98 and toner particles 100 is dispensed from discharging unit 66. Here also the ratio of toner particles 100 to carrier granules 98 by weight being dispensed to developer material 60 in chamber 62 of housing 64 is substantially greater than the ratio of toner particles to carrier granules by weight of developer material 60.

In recapitulation, it is clear that the development apparatus of the present invention continuously adds a trickle of carrier granules to the developer material within the chamber of the developer housing so as to extend the usable life of the developer material to at least that of the electrophotographic printing machine.

It is, therefore, event that there has been provided in accordance with the present invention, an apparatus for developing an electrophotographic latent image that employs a developer material having a usable life at least equal to that of the usable life of the electrophotographic printing machine. This apparatus fully satisfies the aims and advantages hereinbefore set forth. While this invention has been described in conjunction with various embodiments thereof, it is evident that many alternatives, modifications and variations will apparent to those skilled in the art. Accordingly, it is intended to embrace all such alternatives, modifications and variations that fall within the spirit and broad scope of the appended claims.

We claim:

1. An apparatus for developing an electrostatic latent image employed in a printing machine having a finite usable life, including:

means for transporting a developer material comprising at least carrier granules and toner particles into contact with the electrostatic latent image;

a housing defining a chamber having a supply of developer material therein, said transporting means being in communication with the chamber of said housing for receiving developer material; and means for discharging toner particles and carrier granules into the chamber of said housing with the carrier granules being added to the chamber of said housing so that the usable life of the developer material is at least equal to the usable life of the printing machine and with the ratio of toner particles to carrier granules by weight being supplied to the chamber of said housing being substantially greater than the ratio of toner particles to carrier granules by weight in the chamber of said housing.

2. An apparatus according to claim 1, wherein said discharging means adds carrier granules to the chamber of said housing at a rate which is a function of the rate of aging of the carrier material in the chamber of said housing and the required charging ability of the toner particles in the chamber of said housing to insure that the usable life of the developer material in the chamber of said housing is at least equal to the life of the printing machine.

3. An apparatus according to claim 1, wherein said discharging means includes:

means for storing a supply of toner particles; and means for storing a supply of carrier granules.

4. An apparatus according to claim 3, wherein said carrier granule storing means dispenses carrier granules into said toner particle storing means which dispenses carrier granules and toner particles into the chamber of said housing.

5. An apparatus according to claim 1, wherein said discharging means includes means for storing a supply of carrier granules and toner particles.

6. An apparatus according to claim 1, wherein said discharging means discharges carrier granules into the chamber of said housing of a different chemical composition than the carrier granules in the chamber of said housing prior to the initiation of the discharge of carrier granules thereto.

7. An apparatus according to claim 1, wherein said discharging means discharges carrier granules into the chamber of said housing having substantially the same chemical compositions as the carrier granules in the chamber of said housing prior to the initiation of the discharge of carrier granules thereto.

8. An apparatus according to claim 1, wherein said housing includes an exit port for removing developer material from the chamber thereof when the quantity of developer material therein is greater than a predetermined quantity.

9. An electrophotographic printing machine having a finite usable life, including:

a photoconductive member adapted to have an electrostatic latent image recorded on the surface thereof;

means for transporting a developer material comprising at least carrier granules and toner particles into contact with the surface of the photoconductive member having the electrostatic latent image recorded thereon;

a housing defining a chamber having a supply of developer material therein, said transporting means being positioned in the chamber of said housing for receiving developer material; and means for discharging toner particles and carrier granules into the chamber of said housing with the carrier granules being added to the chamber of said housing so that the usable life of the developer material is at least equal to the usable life of the electrophotographic printing machine and with the ratio of toner particles to carrier granules by weight being supplied to the chamber of said housing being substantially greater than the ratio of toner particles to carrier granules by weight in the chamber of said housing.

10. A printing machine according to claim 9, wherein said discharging means adds carrier granules to the chamber of said housing at a rate which is a function of the rate of aging of the carrier material in the chamber of said housing and the required charging ability of the toner particles in the chamber of said housing to insure that the usable life of the developer material in the chamber of said housing is at least equal to the life of the electrophotographic printing machine.

11. A printing machine according to claim 9, wherein said discharging means includes:

means for storing a supply of toner particles; and means for storing a supply of carrier granules.

12. A printing machine according to claim 11, wherein said carrier granule storing means dispenses carrier granules into said toner particle storing means which dispenses carrier granules and toner particles into the chamber of said housing.

13. A printing machine according to claim 9, wherein said discharging means includes means for storing a supply of carrier granules and toner particles.

14. A printing machine according to claim 9, wherein said discharging means discharges carrier granules into the chamber of said housing of a different chemical composition than the carrier granules in the chamber of said housing prior to the initiation of the discharge of carrier granules thereto.

15. A printing machine according to claim 9, wherein said discharging means discharges carrier granules into the chamber of said housing having substantialy the same chemical compositions as the carrier granules in the chamber of said housing prior to the initiation of the discharge of carrier granules thereto.

16. A printing machine according to claim 9, wherein said housing includes an exit port for removing developer material from the chamber thereof when the quantity of developer material therein is greater than a predetermined quantity.

17. A method of developing an electrostatic latent image recorded on a photoconductive member employed in an electrophotographic printing machine having a finite usable life, including the steps of:

transporting a developer material comprising at least carrier granules and toner particles from a housing storing a supply thereof in a chamber to the surface of the photoconductive member having the electrostatic latent image recorded thereon; and discharging toner particles and carrier granules into the chamber of said housing with the carrier granules being added to the chamber of said housing so that the usable life of the developer material is at least equal to the usable life of the electrophotographic printing machine and with the ratio of toner particles to carrier granules by weight being supplied to the chamber of the housing being substantially greater than the ratio of toner particles to carrier granules by weight in the chamber of said housing.

18. A method according to claim 17, wherein said step of discharging includes the step of adding carrier granules to the chamber of the housing as a function of the rate of aging of the carrier material in the chamber of the housing and the required charging ability of the toner particles in the chamber of the housing to insure that the usable life of the developer material in the chamber of the housing is at least equal to the life of the electrophotographic printing machine.

19. A method according to claim 17, wherein said step of discharging includes the steps of:

storing a supply of toner particles in a toner container; and storing a supply of carrier granules in a carrier container.

20. A method according to claim 19, wherein said step of discharging includes the step of dispensing carrier granules from the carrier container to the toner container so that the carrier granules are intermingled with the toner particles.

21. A method according to claim 17, wherein said step of discharging includes the step of storing a supply of carrier granules and toner particles in a container.

22. A method according to claim 17, wherein said step of discharging includes the step of adding carrier granules into the chamber of the housing having a different chemical composition than the carrier granules in the chamber of the housing prior to the initiation of said step of discharging.

23. A method according to claim 17, wherein said step of discharging includes the step of adding carrier granules into the chamber of the housing having substantially the same chemical composition as that of the carrier granules in the chamber of the housing prior to the initiation of said step of discharging.

24. A method according to claim 17, further including the step of removing developer material from the chamber of the housing when the quantity of developer material therein exceeds a predetermined quantity.

* * * * *